United States Patent [19]

Terauchi

[11] Patent Number: 4,846,049

[45] Date of Patent: Jul. 11, 1989

[54] WOBBLE PLATE TYPE COMPRESSOR WITH VARIABLE DISPLACEMENT MECHANISM

[75] Inventor: Kiyoshi Terauchi, Gunma, Japan

[73] Assignee: Sanden Corporation, Gunma, Japan

[21] Appl. No.: 172,964

[22] Filed: Mar. 22, 1988

Related U.S. Application Data

[63] Continuation of Ser. No. 918,065, Oct. 14, 1986, abandoned.

[30] Foreign Application Priority Data

Oct. 11, 1985 [JP] Japan ..... 60-226394

[51] Int. Cl.[4] ..... F01B 3/00; F01B 13/04

[52] U.S. Cl. ..... 92/12.2; 417/269; 74/60

[58] Field of Search ..... 92/12.2; 417/269; 91/504, 505, 506

[56] References Cited

U.S. PATENT DOCUMENTS

| | | | |
|---|---|---|---|
| 723,709 | 1/1932 | Beduneau | 92/12.2 |
| 2,299,235 | 6/1937 | Snader | 91/506 |
| 2,400,119 | 5/1946 | Joy | 417/269 |
| 2,682,226 | 6/1954 | Brennan | 417/269 |
| 3,062,020 | 11/1960 | Heidorn | 417/269 |
| 4,174,191 | 11/1979 | Roberts | 417/269 |
| 4,231,713 | 11/1980 | Widdowson et al. | 417/269 |
| 4,294,139 | 10/1981 | Bex et al. | 91/506 |
| 4,433,596 | 2/1984 | Scalzo | 92/12.2 |
| 4,506,648 | 3/1985 | Roberts | 92/12.2 |
| 4,543,043 | 9/1985 | Roberts | 417/222 |

FOREIGN PATENT DOCUMENTS

| | | | |
|---|---|---|---|
| 300817 | 10/1954 | Fed. Rep. of Germany | 91/505 |
| 2524148 | 5/1975 | Fed. Rep. of Germany | 417/269 |
| 994424 | 1/1920 | France | 92/12.2 |
| 0221476 | 12/1984 | Japan | 417/269 |

*Primary Examiner*—Robert E. Garrett
*Assistant Examiner*—Thomas Denion
*Attorney, Agent, or Firm*—Banner, Birch, McKie & Beckett

[57] ABSTRACT

A wobble plate type compressor with a variable displacement mechanism is disclosed. The compressor is provided with a variable angle rotating cylindrical member which is hingedly connected to a rotor. The rotor is fixed on the drive shaft and supports the wobble plate. The cylindrical member is formed with a central hole for receiving the drive shaft. The inner surface of the hole is formed so as to partially contact the drive shaft and restrict the radial movement of the cylindrical member while permitting variance of the angle of the cylindrical member.

6 Claims, 5 Drawing Sheets

WOBBLE PLATE TYPE COMPRESSOR WITH VARIABLE DISPLACEMENT MECHANISM

This application is a continuation of application Ser. No. 918,065 filed Oct. 14, 1986, now abandoned.

TECHNICAL FIELD

The present invention relates to a wobble plate type compressor with a variable displacement mechanism. More particularly, the present invention relates to a support mechanism for a variable displacement mechanism which permits easily changing the inclined angled of the wobble plate.

BACKGROUND OF THE INVENTION

A wobble plate type compressor which reciprocates pistons by converting the rotational movement of a cam rotor into nutational movement of a wobble plate is well known in the art. Changing the inclined angle of the wobble plate changes the stroke of the pistons and therefore changes the displacement volume of the cylinder. In U.S. Pat. Nos. 3,062,020 and 4,061,443, a wobble plate is proximately disposed on a variable angle rotating cylindrical member. The cylindrical member is hingedly connected to a rotor which is fixed on the drive shaft. The rotor permits varying the inclined angle of the cylindrical member. Movement of the cylindrical member is controlled by the pressure difference between the crank chamber and the suction chamber. In this structure the rotor is connected to the cylindrical member only by the connecting hinge mechanism; therefore, the varying angle of the cylindrical member is not stable.

One solution to this problem is shown in U.S. Pat. No. 4,061,443 which uses a slider element. The slider element is slidably disposed on the drive shaft and is coupled to the cylindrical member through a pin extending from the slider element. The angle of the cylindrical member is therefore determined by the sliding motion and the location of the slider element.

Furthermore, in an axial piston type compressor, the acting point of the piston gas pressure on the cylindrical member is shifted from the top dead center point of the piston, and is eccentrically located in the direction perpendicular to the surface of the angle of the inclined surface of the cylindrical member. This is best illustrated in FIG. 1 where S is the inclined surface, D is the top dead center point of the piston, O is the driving axis line, P1 is the direction of the angle of the inclined surface, P2 is the direction perpendicular to P1, and F is the piston gas pressure. As shown in FIG. 1, the piston gas pressure acts eccentrically on the inclined surface. A moment is generated to rotate the inclined plate around P2. Another moment is generated to rotate the cylindrical member around P1. To accommodate these moments, the supporting structure for the cylindrical member must be highly rigid.

In the structure shown in U.S. Pat. No. 4,061,443, in order to increase the strength of the support mechanism the support structure becomes larger and more complicated. In order to accommodate this enlarged support structure, the compressor must be larger.

SUMMARY OF THE INVENTION

It is an object of this invention to provide a wobble plate type compressor with a variable displacement mechanism which is simple in construction and low in cost while being highly durable.

It is another object of this invention to provide a wobble plate type compressor with a variable displacement mechanism which is compactly designed.

A wobble plate type compressor with a variable displacement mechanism according to this invention includes a compressor housing having a crank chamber and a cylinder block in which a plurality of cylinders are formed. A plurality of pistons are reciprocatingly disposed within the cylinders. A drive shaft is rotatably supported in the housing. A rotor having an inclined surface is fixed on the drive shaft and is hingedly connected to a variable angle rotating cylindrical member. The cylindrical member has a central hole through which the drive shaft passes. The inner surface of this hole contacts the outer surface of the drive shaft. This restricts radial movement of the cylindrical member and the wobble plate even when the angle of the cylindrical member varies. A wobble plate, disposed proximate the cylindrical member, is coupled to the pistons.

Various additional advantages and features of novelty which characterize the invention are further pointed out in the claims that follow. However, for a better understanding of the invention and its advantages reference should be made to the accompanying drawings and descriptive matter which illustrate and describe preferred embodiments of the invention.

DETAILED DESCRIPTION OF PREFERRED EMBODIMENTS

Figure 3:
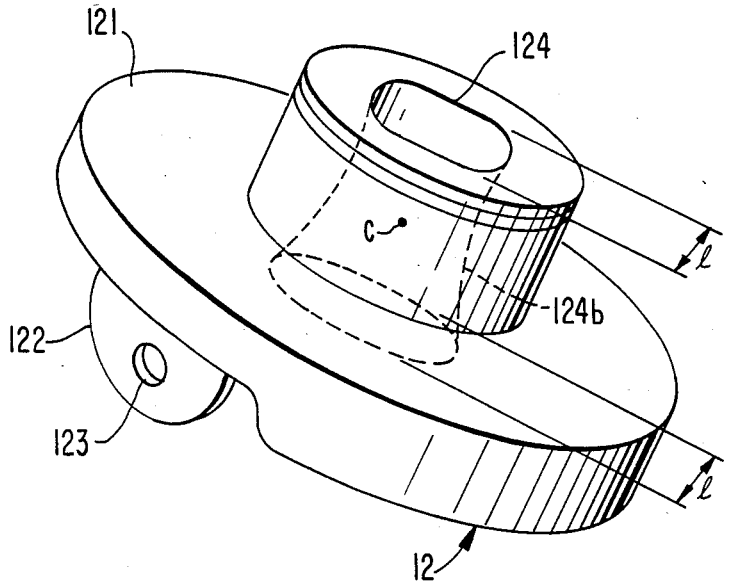
FIG. 3 is a perspective view of the inclined plate shown in FIG. 2.
Figure 2:
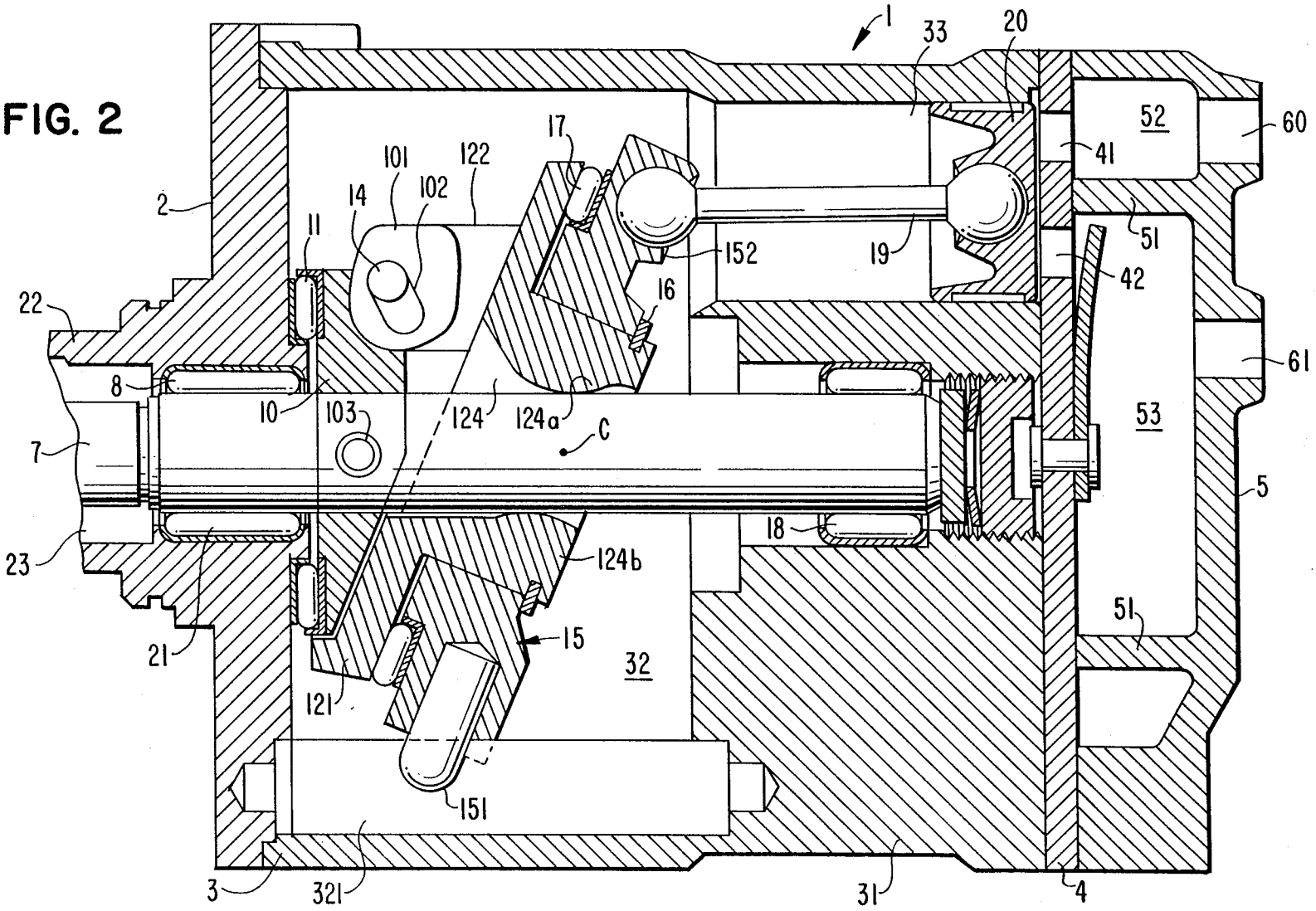
FIG. 2 is a vertical sectional view of a wobble plate type compressor in accordance with one embodiment of this invention.

Referring to FIGS. 2 and 3, wobble plate type compressor 1 includes front end plate 2, cylinder casing 3 having cylinder block 31, valve plate 4, and cylinder head 5. Front end plate 2 is fixed on one end of cylinder casing 3 by securing bolts (not shown). Axial hole 21, which is formed through the center of front end plate 2, receives drive shaft 7. Radial bearing 8 is disposed in axial hole 21 to rotatably support drive shaft 7. Annular sleeve portion 22 projects from front end plate 2 and surrounds drive shaft 7, defining seal cavity 23. Cylinder casing 3 is provided with cylinder block 31 and crank chamber 32. Cylinder block 31 has a plurality of equiangularly spaced cylinders 33 formed therein.

Cam rotor 10 is fixed on drive shaft 7 by pin 103. Thrust needle bearing 11 is disposed between the inner wall surface of front end plate 2 and the adjacent axial end surface of cam rotor 10. Arm portion 101 of cam rotor 10 extends in the direction of cylinder block 31. Elongated hole 102 is formed on arm portion 101. Cylindrical member 12, provided with flange portion 121, is disposed around drive shaft 7. Second arm portion 122 is formed on the outer surface of flange portion 121 of cylindrical member 12 and faces arm portion 101 of cam rotor 10. Hole 123, formed in arm portion 122, is aligned with elongated hole 102. Pin 14, inserted through hole 123, is slidably moveable within elongated hole 102. Ring-shaped wobble plate 15 is mounted on the outer surface of cylindrical member 12 and is prevented from axial movement by flange portion 121 and snap ring 16 disposed on cylindrical member 12. Thrust needle bearing 17 is disposed in a gap between flange portion 121 and wobble plate 15. The other end of drive shaft 7 is rotatably supported through radial bearing 18 in the central bore of cylinder block 31. Sliding shaft 151 is attached on the outer peripheral portion of wobble plate 15 and projects toward the bottom surface of cylinder casing 3. The end of sliding shaft 151 is slidably disposed in groove 321 to prevent the rotation of wobble plate 15.

One end of piston rod 19 is rotatably connected to receiving surface 152 of wobble plate 15. The other end of piston rod 19 is rotatably connected to piston 20 which is slidably disposed in cylinder 33.

Suction ports 41 and discharge ports 42 are formed in valve plate 4. Suction reed valve (not shown) is disposed on valve plate 4. Discharge reed valve (not shown) is disposed on valve plate 4 opposite the suction reed valve. Cylinder head 5 is connected to cylinder casing 3 through a gasket (not shown) and valve plate 4. Partition wall 51 extends axially from the inner surface of cylinder head 5 and divides the interior of cylinder head 5 into suction chamber 52 and discharge chamber 53. Suction chamber 52 is connected to the external fluid circuit through fluid inlet port 60 formed in cylinder head 5. Discharge chamber 53 is connected to the external fluid circuit through fluid outlet port 61 formed in cylinder head 5.

Crank chamber 32 of cylinder casing 3 and suction chamber 52 of cylinder head 5 are connected to one another to control the angle of cylindrical member 12 and wobble plate 15. The structure of the connecting means and the control method for varying the inclined angle of cylindrical member 12 and wobble plate 15 may be of the form disclosed in U.S. Pat. No. 3,062,020.

Cylindrical member 12 has elongated hole 124 formed centrally through it as shown in FIG. 3. The shorter dimension of the opening of hole 124 passing through its center is indicated as "1". This dimension is just large enough to accommodate drive shaft 7 with minimum clearance. The longer dimension of hole 124, passing through its center and perpendicular to the shorter dimension "1", is much larger than the outer diameter of drive shaft 7. This longer dimension varies in length along the axial length of hole 124 and accommodates the total range of angle variance of cylindrical member 12 and wobble plate 15. On the under side of cylindrical member 12 as shown in FIG. 3 (the side facing cam rotor 10), hole 124 is enlarged to permit the changes in, and define the limits of, the inclined angle of cylindrical member 12 and wobble plate 15. The upper and lower inner surfaces of hole 124, as viewed in FIG. 2 and shown more clearly in FIG. 3, are formed as upper curved surface **124*a* and lower curved surface 124*b*. Curved surfaces 124*a* and 124*b* are separated by the varying longer dimension and define the end surfaces of the longer dimension. Curved surfaces 124*a*, 124*b* from at least one contact point with the outer peripheral surface of drive shaft 7. This contact point continuously shifts as the angle of cylindrical member 12** is varied.

The nutating motion of wobble plate 15 is generated by the rotating motion of drive shaft 7. Wobble plate 15 thus should have its center of nutational (wobbling) motion (C) located at its geometric center, which is the central axis of drive shaft 7, in order to compensate for inertia forces, as well as the vibration of the compressor, which act on cylindrical member 12 and wobble plate 15. Therefore, radial movement of cylindrical member 12 should be restricted to keep constant the position of the nutating motion center (C) of wobble plate 15, as cylindrical member 12 supports wobble plate 15 for nutational motion. The contact points between curved surfaces **124*a* and 124*b* and drive shaft 7, and the shorter sides of hole 124 (separated by the distance "1") and drive shaft 7 restrict radial movement of cylindrical member 12. Thus, the center of nutational motion is normally aligned on the central axis of drive shaft 7 even when the angle of cylindrical member 12 and wobble plate 15** is changed.

Figure 4:
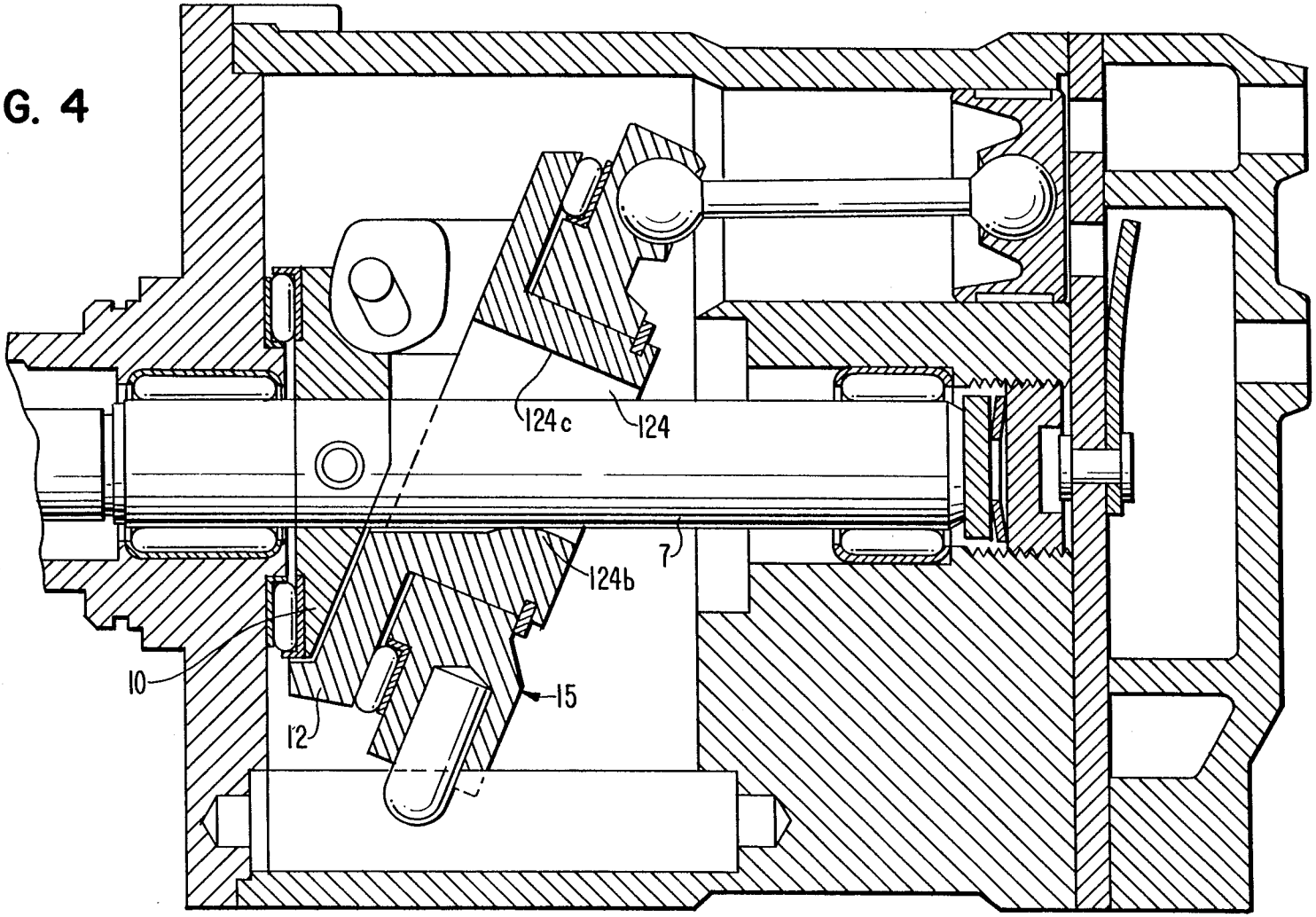
FIG. 4 is a sectional view of a wobble plate type compressor in accordance with another embodiment of this invention.

In the structure shown in FIGS. 2 and 3, the compression forces acting on piston 20 urge lower curved surface **124*b* against the outer surface of drive shaft 7 to securely contact drive shaft 7, while upper curved surface 124*a* thus merely touches the outer surface of drive shaft 7. The upper surface of central hole 124 therefore may be formed as a flat surface 124*c* as shown in FIG. 4**.

Figure 1:
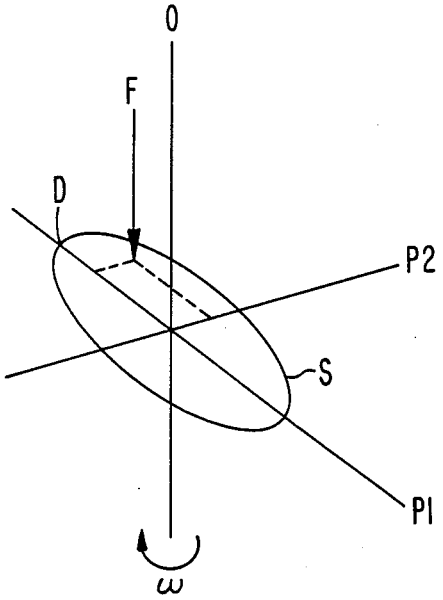
FIG. 1 is a diagramatic sketch illustrating the forces acting on the surface of an inclined plate.
Figure 6:
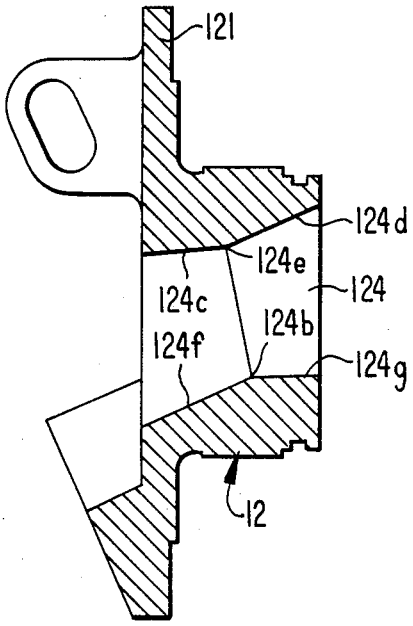
FIG. 6 is a sectional view of the inclined plate used in the compressor shown in FIG. 5.
Figure 5:
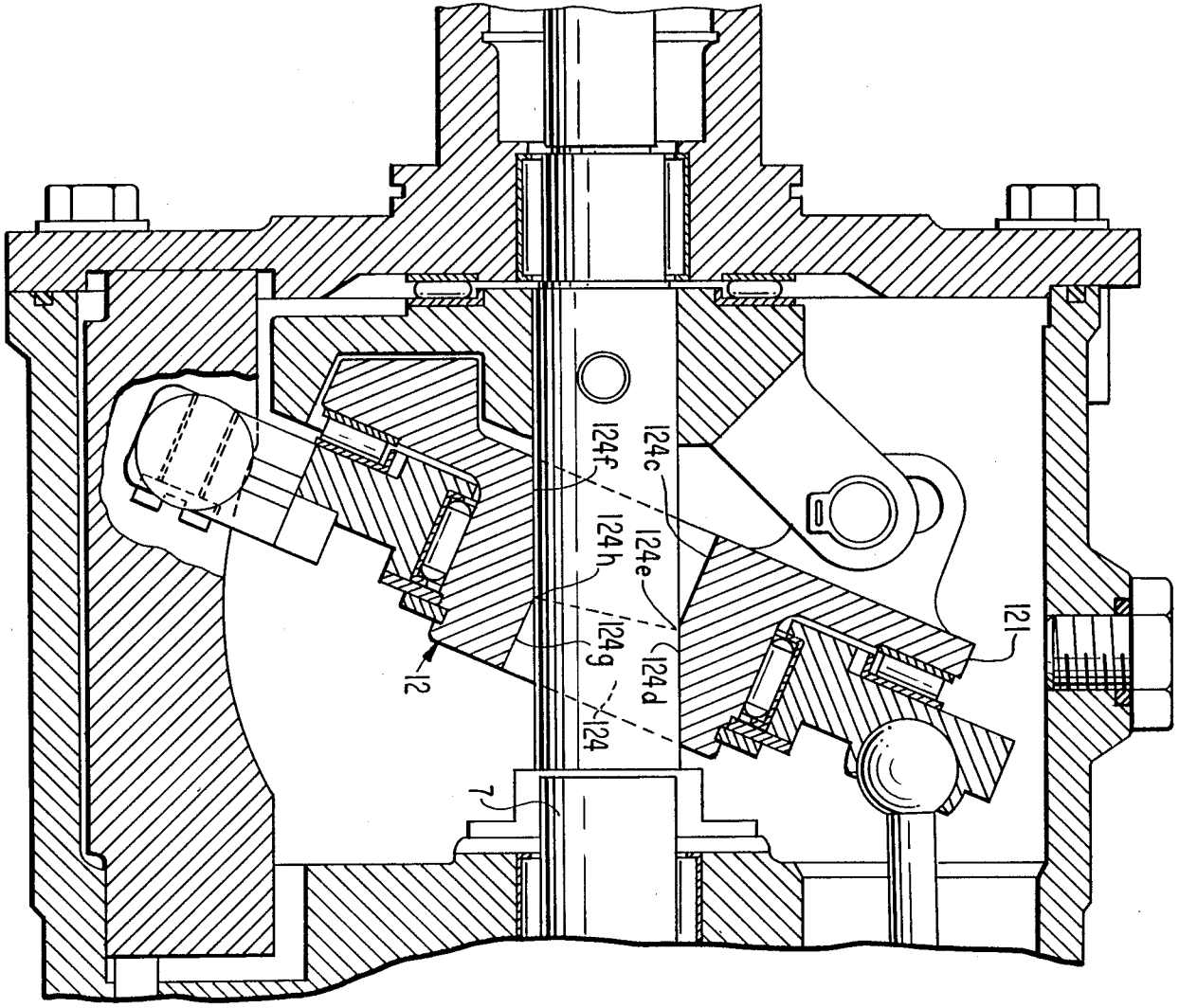
FIG. 5 is a sectional view of a wobble plate type compressor illustrating the variable displacement mechanism in accordance with still another embodiment of this invention.

FIGS. 5 and 6 illustrate another embodiment of this invention wherein the inner surface of hole 124 is modified. The upper and lower surfaces of hole 124 are each formed as two planes having different angles relative to the central axis of cylindrical member 12. The upper surface comprises two planes shown in the figures as lines **124*c* and 124*d*. Connecting point 124*e* between lines 124*c* and 124*d* is the contact point with drive shaft 7. The lower surface comprises two planes shown as lines 124*f* and 124*g*. Connecting point 124*h*, located at the intersection of lines 124*f* and 124*g*, if the contact point with the outer surface of drive shaft 7. Line 124*c* is parallel to line 124*g* and line 124*d* is parallel to line 124*f*. As best shown in FIG. 5, the angular difference between the lines determines the maximum and minimum inclined angles of cylindrical member 12**.

Figure 7:
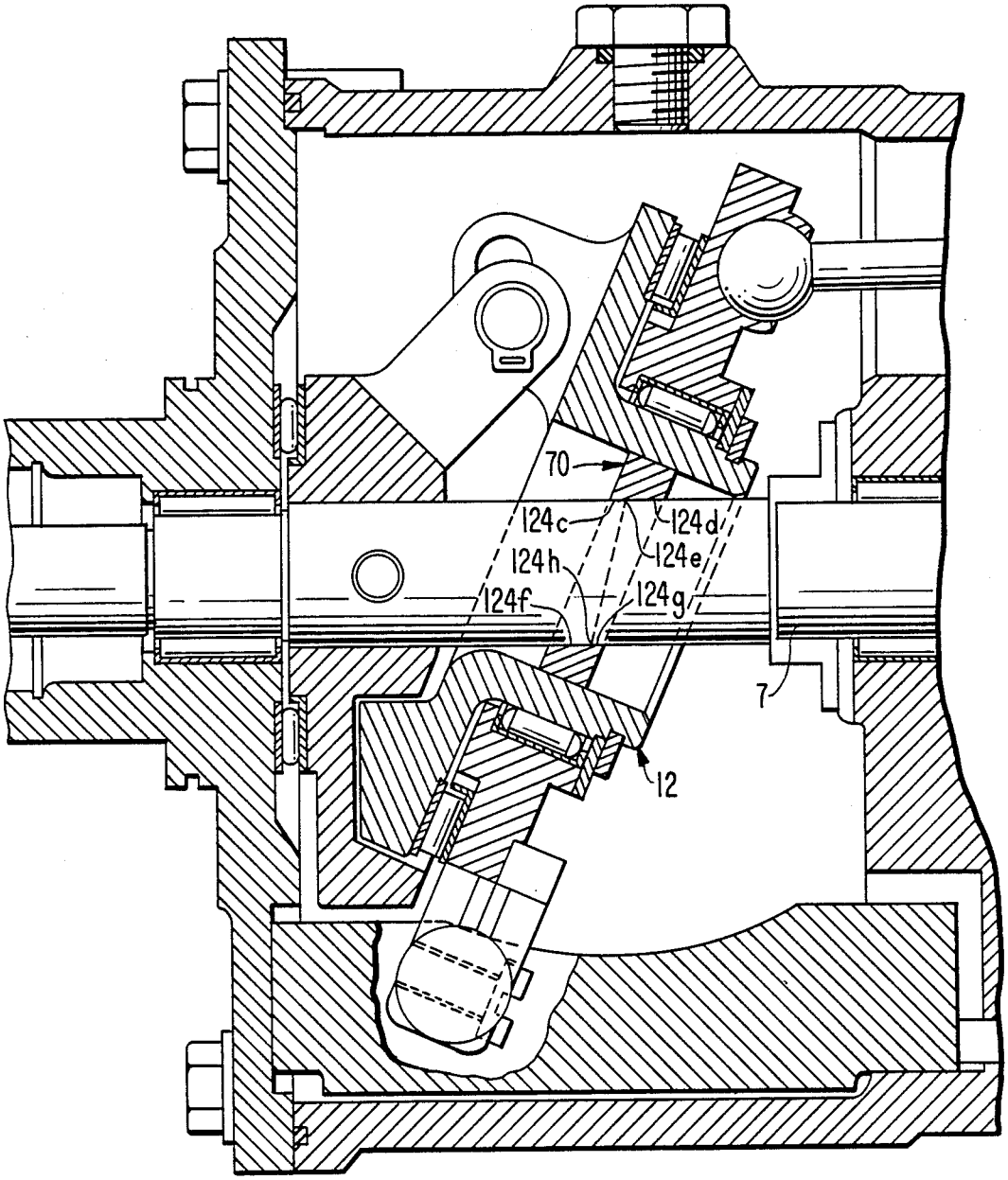
FIG. 7 is a sectional view of a wobble plate type compressor illustrating the variable displacement mechanism in accordance with still another embodiment of this invention.

The planes for restricting the inclined angle of cylindrical member 12 may be formed on separate ring member 70 fixedly disposed on the inner peripheral surface of cylindrical member 12 as shown in FIG. 7. In this embodiment, manufacturing the inner surface of cylindrical member 12 is simpler and costs less.

Numerous characteristics, advantages, and embodiments of the invention have been described in detail in the foregoing description with reference to the accompanying drawings. However, the disclosure is illustrative only and it is to be understood that the invention is not limited to the precise illustrated embodiments. Various changes and modifications may be affected therein by one skilled in the art without departing from the scope or the spirit of the invention.

I claim:

1. A wobble plate type compressor with a variable displacement mechanism comprising:

a compressor housing having a crank chamber;

a cylinder block disposed in said compressor housing and having a plurality of cylinders disposed therein;

a plurality of pistons, each of said pistons being reciprocatingly disposed in a respective one of said cylinders;

a rotatable drive shaft rotatably supported and axially fixed in said compressor housing;

a rotor fixed on said drive shaft;

a cylindrical member hingedly connected to said rotor so that the angle of said cylindrical member can be varied, said cylindrical member having a central hole formed therethrough for receiving said drive shaft, said cylindrical member being nonfixedly disposed on said drive shaft, an inner surface of said hole having a portion which contacts the outer peripheral surface of said drive shaft to restrict radial movement of said cylindrical member while permitting the angle of said cylindrical member to be varied wherein said cylindrical member is in constant contact with said drive shaft; and a wobble plate proximate said cylindrical member and coupled to said pistons.

2. A wobble plate type compressor with a variable displacement mechanism as set forth in claim 1 wherein said central hole is elongated having a shorter dimension long enough to fit the outer diameter of said drive shaft with minimum clearance.

3. A wobble plate type compressor with a variable displacement mechanism as set forth in claim 2 wherein said elongated hole has a longer dimension perpendicular said shorter dimension to accommodate the total range of cylindrical member angle variance, and convex upper and lower inner surface areas defining end surfaces of said longer dimension and forming at least one contact point with the outer surface of said drive shaft.

4. A wobble plate type compressor with a variable displacement mechanism as set forth in claim 2 wherein said elongated hole has a longer dimensions perpendicular to said shorter dimension to accommodate the total range of cylindrical member angle variance, a convex lower inner surface area and a flat upper inner surface area defining end surfaces of said longer dimension.

5. A wobble plate type compressor with a variable displacement mechanism as set forth in claim 2 wherein said elongated hole has a longer dimension perpendicular to said shorter dimension to accommodate the total range of cylindrical member angle variance, and upper and lower inner surface areas each of which comprise two planes having a different angle relative the central axis of said cylindrical member, said two planes intersecting and forming a point which contacts the outer surface of said drive shaft.

6. A wobble plate type compressor with a variable displacement mechanism as set forth in claim 5 wherein said inner surfaces of said hole are formed on a protruding ring portion said planes being disposed on said protruding ring portion.

* * * * *